US011081311B2

(12) United States Patent
Parker

(10) Patent No.: US 11,081,311 B2
(45) **Date of Patent: *Aug. 3, 2021**

(54) X-RAY TUBE HEAT SINK AND TARGET MATERIAL

(71) Applicant: Moxtek, Inc., Orem, UT (US)

(72) Inventor: Todd S. Parker, Kaysville, UT (US)

(73) Assignee: Moxtek, Inc., Orem, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/906,162

(22) Filed: Jun. 19, 2020

(65) Prior Publication Data

US 2020/0321184 A1 Oct. 8, 2020

Related U.S. Application Data

(63) Continuation of application No. 16/378,834, filed on Apr. 9, 2019, now Pat. No. 10,727,023.

(60) Provisional application No. 62/667,721, filed on May 7, 2018.

(51) Int. Cl.

| | |
|---|---|
| ***H01J 35/08*** | (2006.01) |
| ***H01J 35/18*** | (2006.01) |
| ***H01J 35/12*** | (2006.01) |

(52) U.S. Cl.

CPC ..... *H01J 35/112* (2019.05); *H01J 35/12* (2013.01); *H01J 35/18* (2013.01); *H01J 2235/086* (2013.01); *H01J 2235/1204* (2013.01); *H01J 2235/125* (2013.01); *H01J 2235/1216* (2013.01); *H01J 2235/1245* (2013.01); *H01J 2235/1295* (2013.01)

(58) Field of Classification Search

CPC ..... H01J 2235/1204; H01J 2235/1216; H01J 2235/125; H01J 2235/1295; H01J 35/112; H01J 35/12; H01J 2235/1245

See application file for complete search history.

(56) References Cited

U.S. PATENT DOCUMENTS

| | | | | |
|---|---|---|---|---|
| 1,565,969 | A * | 12/1925 | Spiro | H01J 35/13 378/142 |
| 4,184,097 | A | 1/1980 | Auge | |
| 4,675,890 | A | 6/1987 | Plessis et al. | |
| 5,014,289 | A | 5/1991 | Rothe | |
| 5,535,255 | A | 7/1996 | Gabbay | |
| 6,707,883 | B1 | 3/2004 | Tiearney et al. | |
| 9,251,995 | B2 | 2/2016 | Ogura et al. | |
| 10,178,748 | B1 | 1/2019 | Steck et al. | |
| 10,182,490 | B2 | 1/2019 | Miller et al. | |

(Continued)

FOREIGN PATENT DOCUMENTS

| | | |
|---|---|---|
| JP | 39-12336 | 5/1964 |
| JP | 2001-227338 | 9/1989 |

(Continued)

*Primary Examiner* — Chih-Cheng Kao

(74) *Attorney, Agent, or Firm* — Thorpe, North & Western, LLP

(57) ABSTRACT

An x-ray source can include an x-ray tube, and a heat sink for removal of heat from the x-ray tube. The heat sink can be thermally coupled to the anode and can extend away from the anode along a heat sink longitudinal axis. The heat sink can have a base and a fin extending from the base. The base can have a greater thickness nearer the anode, and a reduced thickness along the heat sink longitudinal axis to a smaller thickness farther from the anode.

20 Claims, 6 Drawing Sheets

(56) References Cited

U.S. PATENT DOCUMENTS

| | | | | |
|---|---|---|---|---|
| 10,727,023 | B2 * | 7/2020 | Parker | H01J 35/112 |
| 2002/0063500 | A1 | 5/2002 | Keren et al. | |
| 2006/0151072 | A1 * | 7/2006 | Daily | B22F 3/162 148/514 |
| 2014/0140486 | A1 * | 5/2014 | Yanagisawa | H05G 1/04 378/141 |
| 2014/0219424 | A1 | 8/2014 | Smith et al. | |
| 2015/0063549 | A1 | 3/2015 | Jeong et al. | |
| 2015/0262783 | A1 | 9/2015 | Eaton et al. | |
| 2017/0287673 | A1 | 10/2017 | Peterson et al. | |

FOREIGN PATENT DOCUMENTS

| | | |
|---|---|---|
| JP | 06131998 | 5/1994 |
| JP | 2004-22302 | 1/2004 |
| JP | 2004187868 | 7/2004 |
| JP | 2006-12591 | 1/2006 |

* cited by examiner

X-RAY TUBE HEAT SINK AND TARGET MATERIAL

PRIORITY CLAIM

This is a continuation of U.S. patent application Ser. No. 16/378,834, filed Apr. 9, 2019, which claims priority to U.S. Provisional Patent Application Ser. No. 62/667,721, filed May 7, 2018, which are hereby incorporated herein by reference.

FIELD OF THE INVENTION

The present application is related generally to x-ray sources.

BACKGROUND

X-ray tubes can include an internal vacuum. Maintaining this internal vacuum can be an important consideration in design of the x-ray tube. Cost reduction can also be an important consideration in x-ray tube design. During operation, x-ray tubes generate heat which can damage components if not removed, so heat removal or transfer can also be important. Designing the x-ray tube for appropriately sized electron beam spot and x-ray spot can also be important.

SUMMARY

It has been recognized that it would be advantageous to improve x-ray source design to better maintain an internal vacuum, to reduce cost, to remove heat, and to have an appropriately sized electron beam spot and x-ray spot. The present invention is directed to various embodiments of x-ray tubes that satisfy these needs. Each embodiment may satisfy one, some, or all of these needs.

The x-ray source can include an x-ray tube, and a heat sink for removal of heat from the x-ray tube. The heat sink can be thermally coupled to the anode and can extend away from the anode along a heat sink longitudinal axis. The heat sink can have a base and a fin extending from the base. The base can have a greater thickness nearer the anode, and a reduced thickness along the heat sink longitudinal axis to a smaller thickness farther from the anode.

BRIEF DESCRIPTION OF THE DRAWINGS (DRAWINGS MIGHT NOT BE DRAWN TO SCALE)

Figure 1:
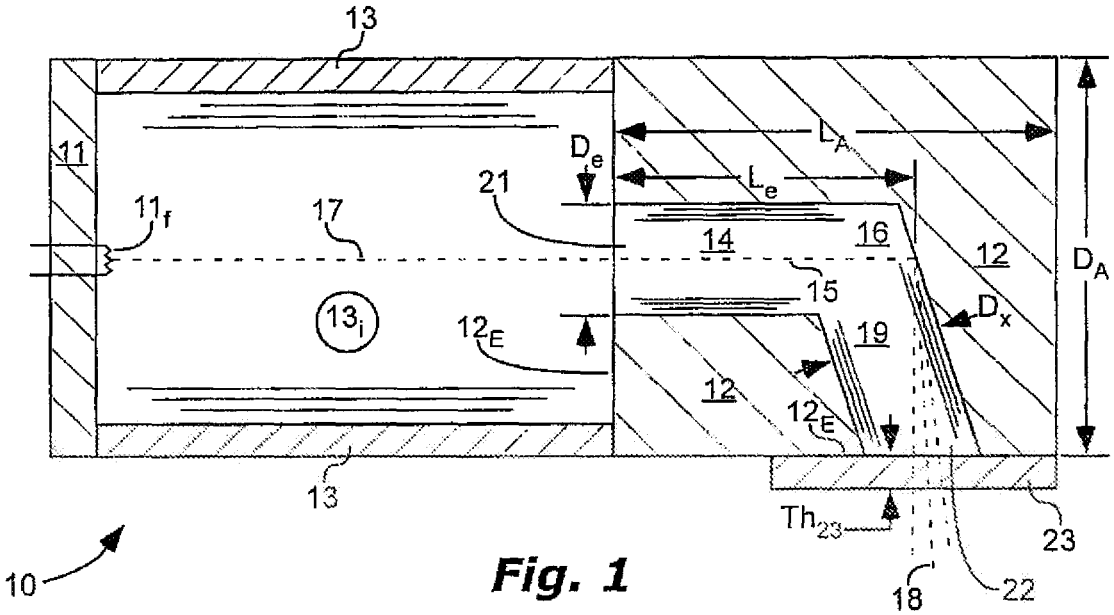
Figure 2:
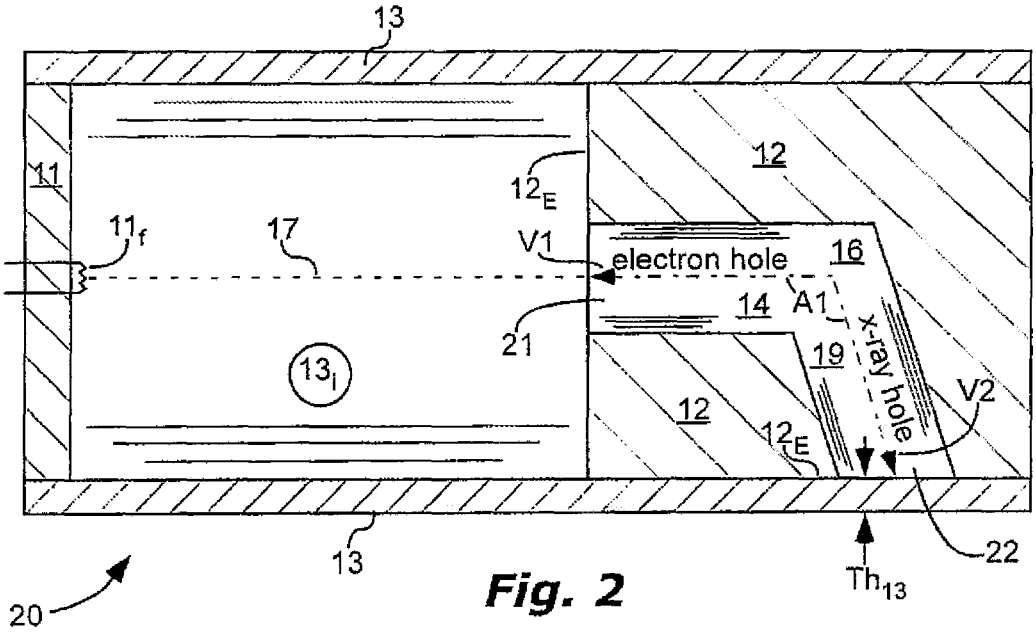

FIGS. 1-2 are schematic, cross-sectional side-views of x-ray tubes 10 and 20 with an anode 12 including an electron hole 14 intersecting an x-ray hole 19 at a core 16 of the anode 12, in accordance with embodiments of the present invention.

Figure 3A:
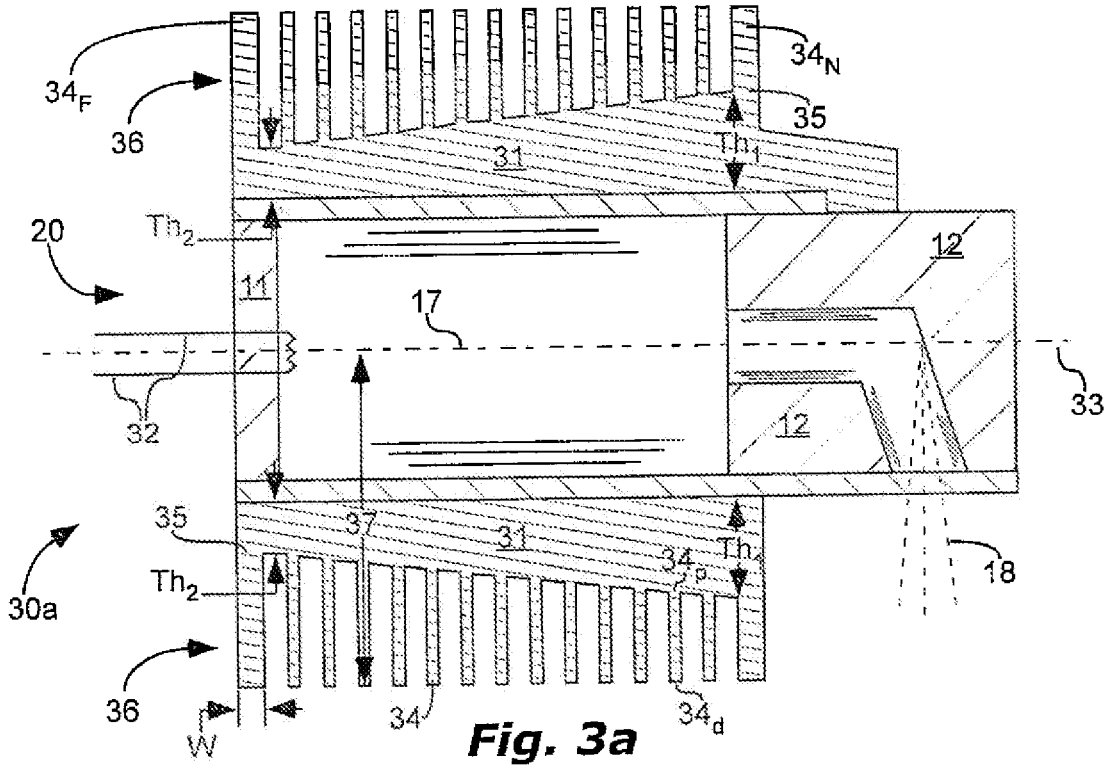
Figure 3B:
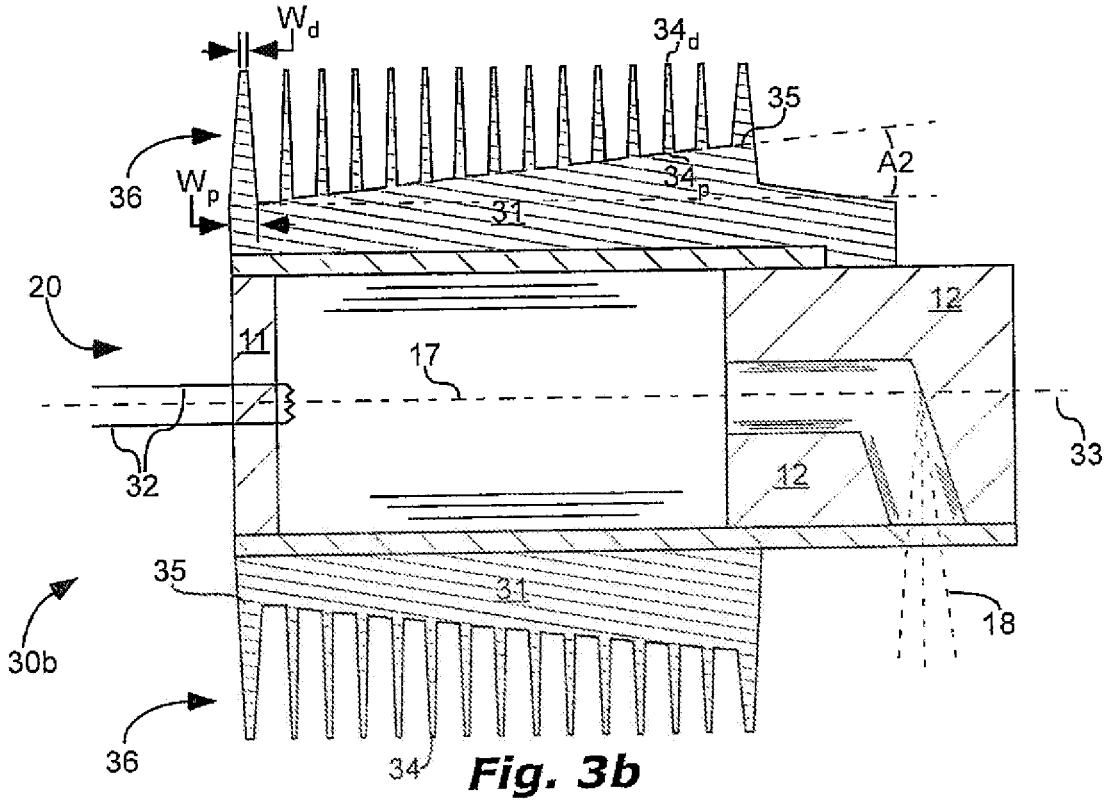
Figure 4:
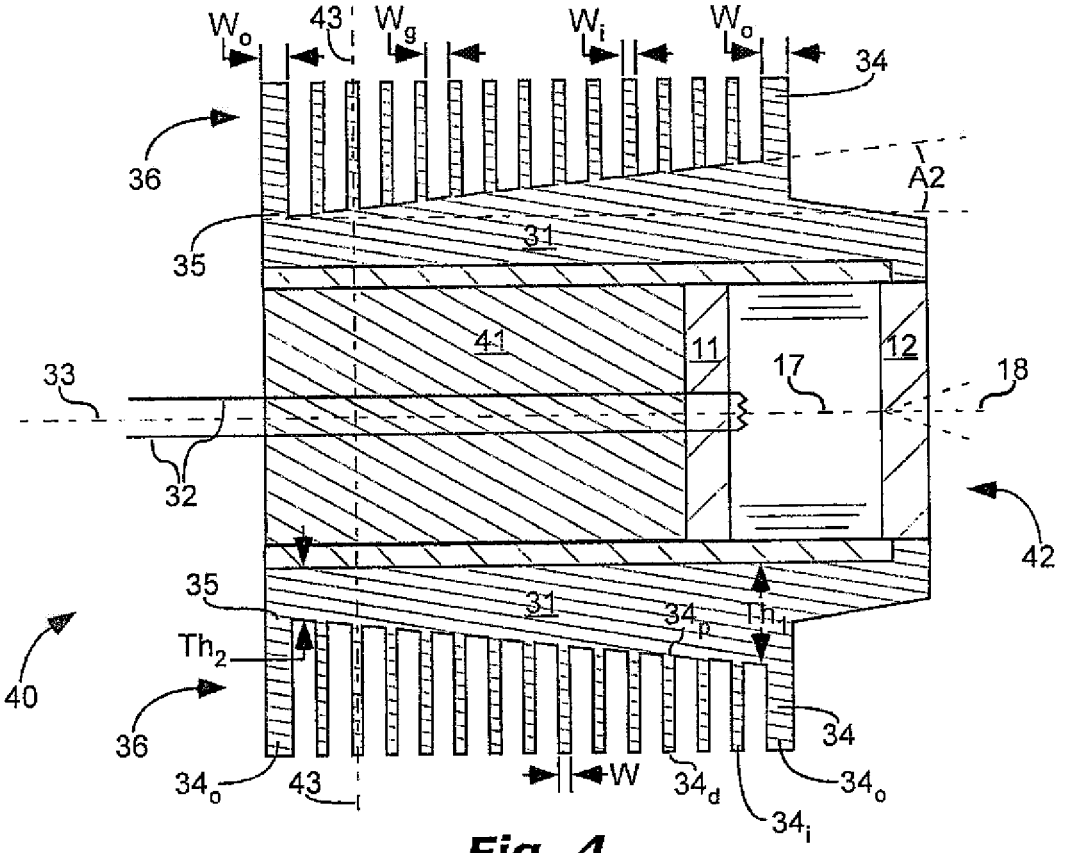

FIGS. 3*a*, 3*b*, and 4 are schematic, cross-sectional side-views of x-ray sources 30*a*, 30*b*, and 40 with an x-ray tube 20 or 42 and a heat sink 35 with a base 31 and an array of fins 36 extending from the base 31, the base 31 having a greater thickness $Th_1$ nearer the anode 12 and reducing in thickness along the heat sink longitudinal axis to a smaller thickness $Th_2$ farther from the anode 12, in accordance with embodiments of the present invention.

Figure 5:
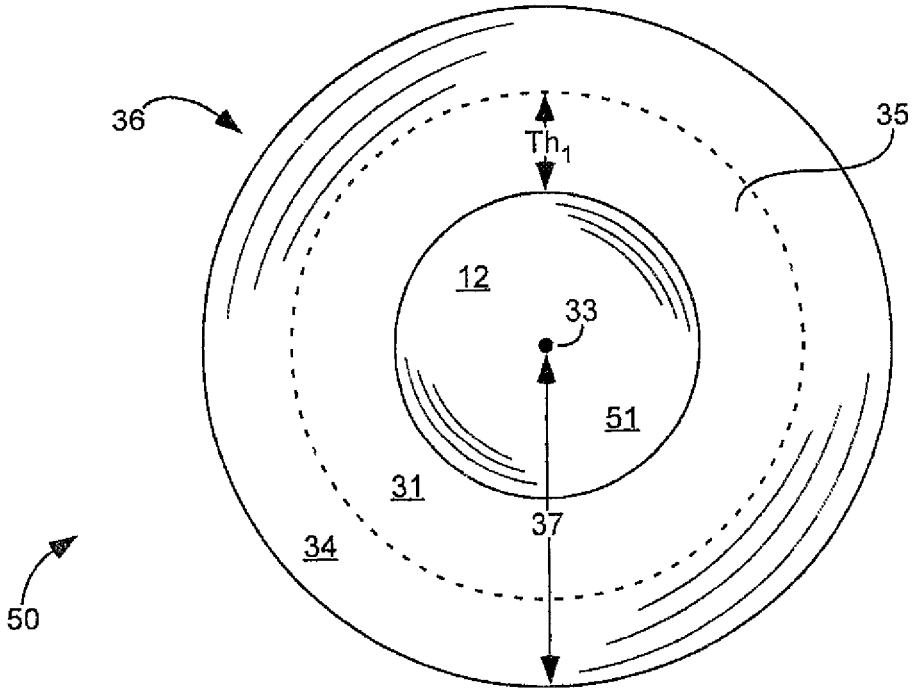
Figure 6:
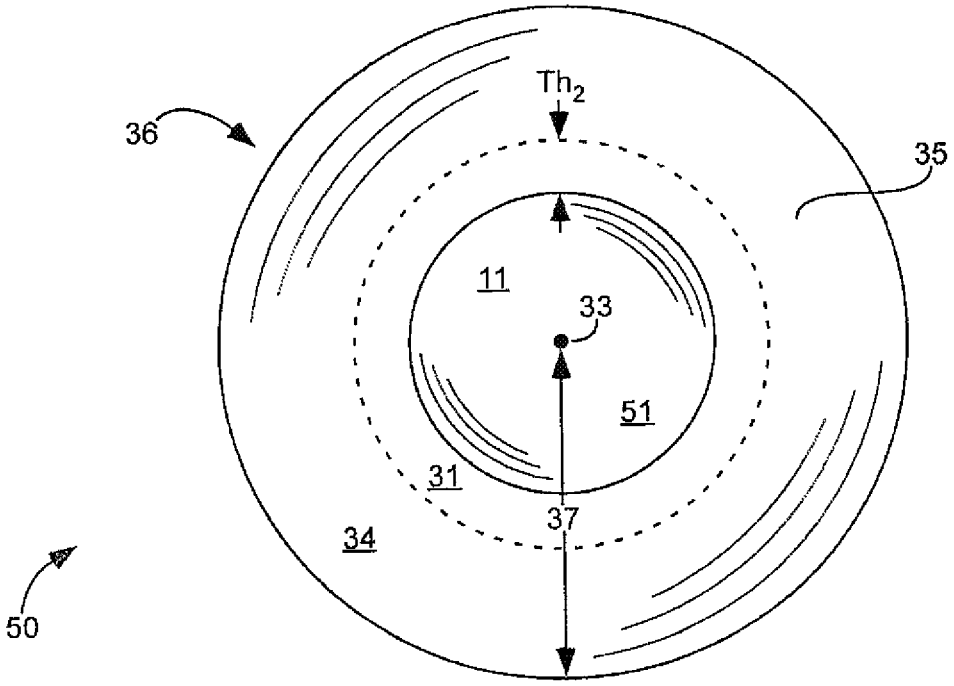

FIGS. 5-6 are schematic end-views of x-ray source 50, including an x-ray tube 51 (showing the anode 12 end of the x-ray tube 51 in FIG. 5 and the cathode 11 end of the x-ray tube 51 in FIG. 6) and a heat sink 35 similar to the heat sink 35 in FIGS. 3*a*-4, the array of fins 36 being annular and circumscribing the base 31, in accordance with an embodiment of the present invention.

Figure 7:
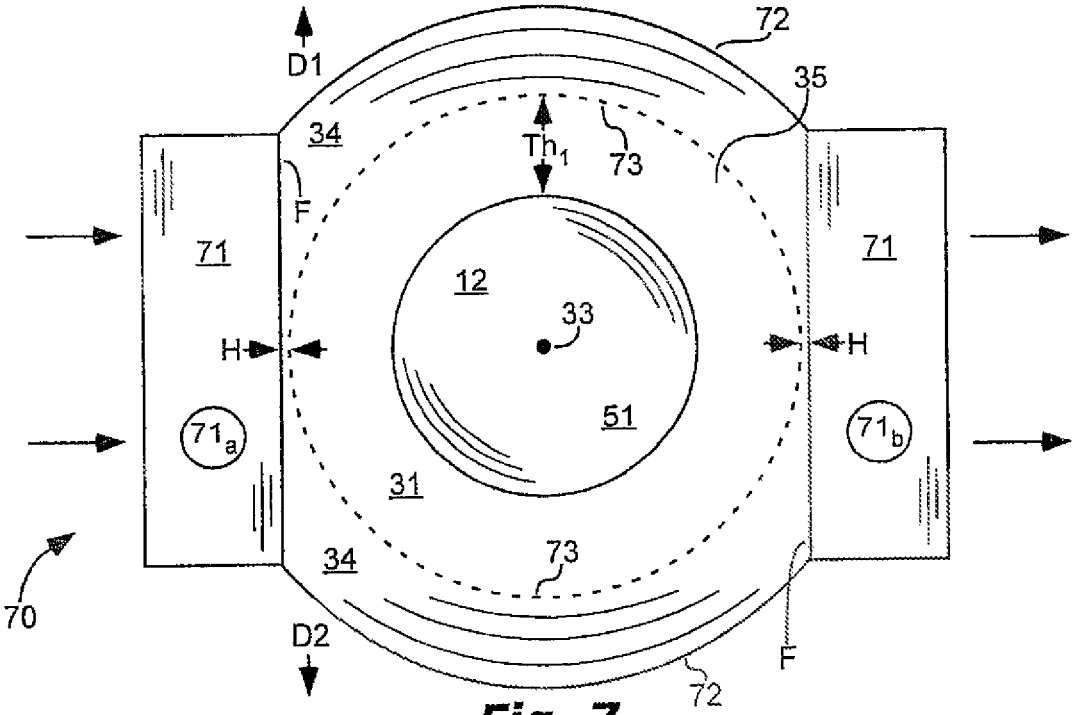
Figure 8:
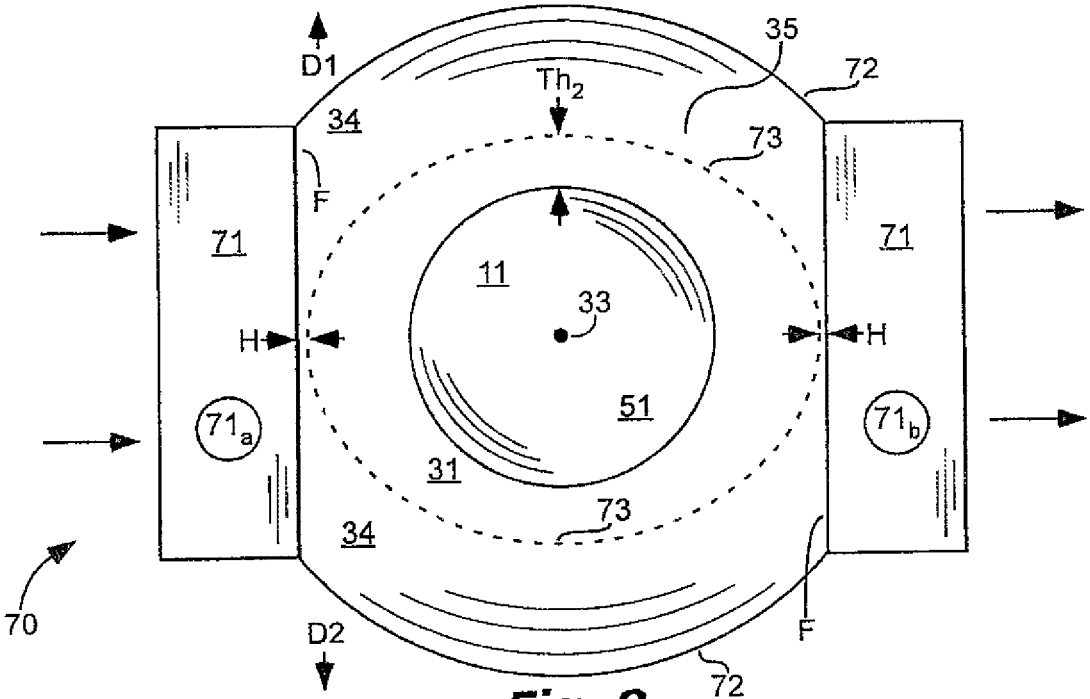

FIGS. 7-8 are schematic end-views of x-ray source 70, including an x-ray tube 51 and a heat sink 35 similar to the heat sink 35 in FIGS. 3*a*-4, an outer perimeter 72 of the array of fins 36 in each of two opposite directions D1 and D2 having a convex shape, the array of fins 36 including two opposite flat sides F, and a fan 71 mounted at each of the two opposite flat sides F, in accordance with an embodiment of the present invention.

Figure 9:
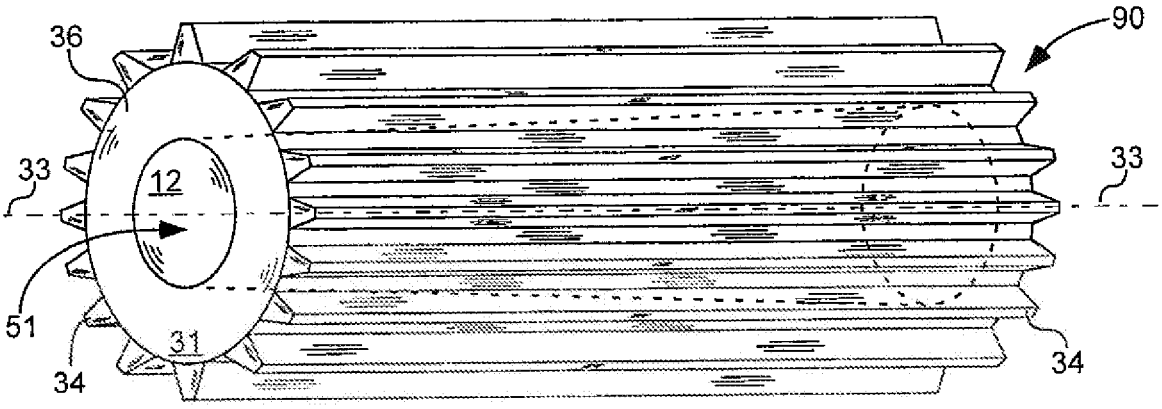

FIG. 9 is a schematic perspective-view of an x-ray source 90 with an x-ray tube 91 like x-ray tube 10 or 42, respectively, and a heat sink 35, similar to the x-ray sources in FIGS. 3*a*-8, except that the fins 34 of x-ray source 90 extend from the base 31 in a direction parallel to the heat sink longitudinal axis 33, in accordance with an embodiment of the present invention.

Figure 10:
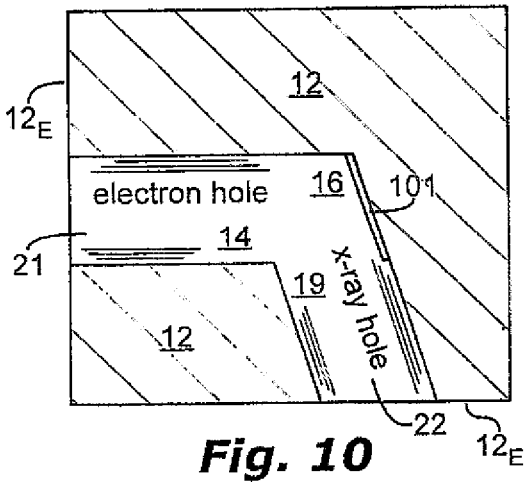
Figure 11:
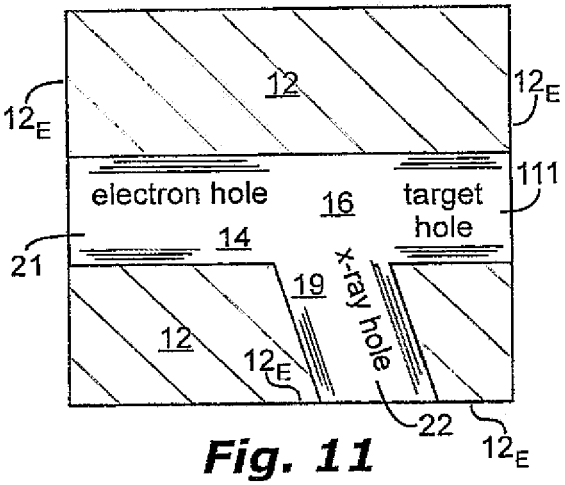
Figure 12:
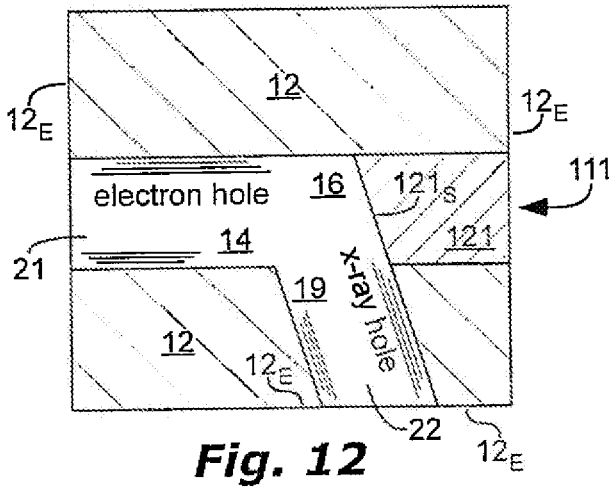

FIGS. 10-12 are schematic perspective-views of anodes 12, in accordance with embodiments of the present invention.

DEFINITIONS

As used herein, the terms "adjoin", "adjoins", and "adjoining" mean direct and immediate contact.

As used herein, the term "mm" means millimeter(s).

As used herein, the term "parallel" means exactly parallel, parallel within normal manufacturing tolerances, or nearly parallel, such that any deviation from exactly parallel would have negligible effect for ordinary use of the device.

As used herein, the term "perpendicular" means exactly perpendicular or within 15° of exactly perpendicular. The term "perpendicular" can mean within 0.1°, within 1°, within 5°, or within 10° of exactly perpendicular if explicitly so stated in the claims.

As used herein, "same distance" or similar phrases means exactly the same distance, the same distance within normal manufacturing tolerances, or nearly the same distance, such that any deviation from exactly the same distance would have negligible effect for ordinary use of the device.

As used herein, the term "$K*m^2/W$" means degrees Kelvin times meters squared divided by watts.

As used herein, the term "W/(m*K)" means watts divided by meters and degrees Kelvin.

As used herein, the term "x-ray tube" means a device for producing x-rays, and which is traditionally referred to as a "tube", but need not be tubular in shape.

DETAILED DESCRIPTION

As illustrated in FIGS. 1-2, x-ray tubes 10 and 20 are shown comprising a cathode 11 and an anode 12. The cathode 11 and the anode 12 can be electrically insulated from one another. The cathode 11 can be configured to emit electrons in an electron beam 17 towards the anode 12 and the anode 12 can be configured to emit x-rays 18 out of the x-ray tube 10 or 20 in response to impinging electrons from the cathode 11.

The anode 12 can be optimized for maintaining an internal vacuum, for low cost, and for electron beam spot and x-ray spot size. A hole, defining an electron hole 14, can extend from an electron entry 21 at an exterior $12_E$ of the anode 12 into a core 16 of the anode 12. The electron hole 14 can be aimed to allow the electrons to pass into the core 16 of the anode 12. Another hole, defining an x-ray hole 19, can extend from an x-ray exit 22 at the exterior $12_E$ of the anode 12 into the core 16 of the anode 12, intersecting the electron hole 14 at the core 16 of the anode 12. The x-ray hole 19 can be aimed for emission of the x-rays 18 from the core 16 of the anode 12 out of the x-ray tube 10 or 20. The electron entry 21 and the x-ray exit 22 can be located on different sides of the anode 12. The electron hole 14 and the x-ray hole 19 can form an open bore from the electron entry 21 to the x-ray exit 22. Thus, the bore can be an unobstructed, uninterrupted path from the electron entry 21 to the x-ray exit 22 without passing through any solid materials. The entire bore from the electron entry 21 to the x-ray exit 22 can be exposed to the internal vacuum of the x-ray tube 10 or 20.

In order to minimize electron backscatter from edges and to avoid additional holes for gas leakage, the electron hole 14 and the x-ray hole 19 can form a single bore from the electron entry 21 to the x-ray exit 22. Thus, the only holes into the core 16 of the anode 12 can be the electron hole 14 and the x-ray hole 19. The single bore can comprise, consist essentially of, or consist of the electron hole 14 intersecting with the x-ray exit 22 in the core 16 of the anode 12. The single bore can be seamless. A single, integral, monolithic anode material can form walls of the electron hole 14, the x-ray hole 19, and the core 16.

In contrast, the anode 12 of FIGS. 11-12 has an additional hole, the target hole 111, and thus this anode 12 does not have a single bore therethrough. Also, the anode 12 of FIG. 12 is not seamless. A seam is formed between the anode 12 and the plug of target material 121. Thus, a disadvantage of the anode 12 of FIGS. 11-12 is increased risk of gas leakage into an interior of the x-ray tube through the target hole 111. The anode 12 of FIGS. 11-12, however, has the advantage of flexibility in selection of target materials. Another advantage is ease of shaping the emitted x-ray beam 18 by curving or otherwise changing a shape of a surface 121*s* of a plug of target material 121.

The electron hole 14, the x-ray hole 19, or both can have concave walls. The electron hole 14, the x-ray hole 19, or both can have a cylindrical shape. The bore in the anode 12 can be manufactured by boring (e.g. drilling, laser cutting, etc.) two intersecting holes in a block of material.

Smooth and concave walls of the bore can improve transmission of electrons to the target and can improve transmission of x-rays out of the x-ray tube. For example, ≥50%, ≥70%, ≥80%, ≥90%, ≥95%, ≥99%, or all of walls of the bore can be concave. The target material can be located at, and the electron beam can impinge on, a concave wall of the core 16 of the anode 12. This concave wall can be shaped, such as by selection of drill bit size or by other method of forming the bore, for optimal shape of the electron beam 17 spot size on the target material and thus for optimal shape of the x-ray spot size.

A diameter $D_e$ of the electron hole 14 and a diameter $D_x$ of the x-ray hole 19 can be similar in size for ease of manufacturing and for improved shaping of the electron beam 17 and the x-ray beam. For example, $D_S/D_L \geq 0.3$, $D/D_L 0.5$, $D_S/D_L \geq 0.7$, $D_S/D_L \geq 0.9$, $D_S/D_L \geq 0.95$, or $D_S/D_L \geq 0.98$; where $D_S$ is a smallest diameter of one of the electron hole 14 or the x-ray hole 19 and $D_L$ is a largest diameter of the other of the electron hole 14 or the x-ray hole 19.

For improved shaping of the electron beam 17, a diameter $D_e$ of the electron hole 14, measured perpendicular to a longitudinal axis of the electron hole 14, can be sized in relation to a width of an electron spot. The electron spot is an area on the wall of the core 16 of the anode 12 upon which ≥85% of the electron beam 17 impinges. The electron spot can have a length (longest dimension) and a width (longest distance perpendicular to the length). For example, the width of the electron spot can be ≤75% or ≤50% of the diameter $D_e$ of the electron hole 14.

As shown in FIG. 2, a first vector V1 can extend along a center of the electron hole 14 from the core 16 of the anode 12 to the exterior $12_E$ of the anode 12. The first vector V1 can be parallel with an axis of the electron beam 17. A second vector V2 can extend along a center of the x-ray hole 19 from the core 16 of the anode 12 to the exterior $12_E$ of the anode 12. The holes can be drilled or otherwise formed at different angles depending on desired emission of x-rays 18. For example, an angle A1 between the first vector V1 and the second vector V2 can be ≥10°, ≥45°, ≥90°, ≥95°, ≥100°, or ≥105° and can be ≤125°, ≤135°, ≤150°, ≤160°, ≤170°, or ≤175°. Angle A1 can be selected to direct the x-rays beam 18 and for shaping of the x-ray beam 18.

A relationship between a size of the anode 12 and a size of the electron hole 14 can be optimized for improved generation of x-rays, heat transfer, and x-ray emission shape. For example, $L_A/L_e \geq 1.3$, $L_A/L_e \geq 1.5$, or $L_A/L_e \geq 1.8$ and $L_A/L_e \leq 2.2$, $L_A/L_e \leq 2.5$, or $L_A/L_e \leq 3$; where $L_A$ is a length of the anode 12 and $L_e$ is a length of the electron hole 14, both lengths parallel to a longitudinal axis of the electron hole 14 (parallel to the first vector V1). For example, $D_A/D_e \geq 1.5$, $D_A/D_e \geq 2$, or $D_A/D_e \geq 2.5$ and $D_A/D_e \geq 3$, $D_A/D_e \leq 3.5$, or $D_A/D_e \leq 5$; where $D_A$ is a diameter of the anode 12 and $D_e$ is a diameter of the electron hole 14, both diameters perpendicular to the longitudinal axis of the electron hole 14. Other relationships between the size of the anode 12 and the size of the electron hole 14 are within the scope of this invention.

The core 16 of the anode 12 can include a target material configured for generation of the x-rays 18 in response to the impinging electrons. The target material can be aligned to face the electron emitter. For simplicity of manufacture, the target material can be integral and monolithic with the anode 12. Material of the anode 12 surrounding the bore can be the target material. A composition of the target material can be the same as a composition of the anode 12. The anode 12 can be the target material. Alternatively, a material composition of the target material can be different from a material composition of the anode 12, allowing more variety of target materials to be used, and saving cost if the material composition of the target material is expensive.

The anode 12 can comprise a material with high atomic number for blocking x-rays from emitting from the x-ray tube 10 or 20 in undesirable directions. For example, the anode 12 can comprise ≥50, ≥75, ≥90, or ≥98 weight percent of materials with atomic number ≥26, ≥29, or ≥74. It can also be helpful for the anode to have relatively high thermal conductivity to conduct heat away from the target material.

One possible composition of the target material and the anode 12 is tungsten and lanthanum oxide. For example, the target material and the anode 12 can each comprise one or more of the following: ≥90, ≥95, ≥97, ≥98, or ≥98.5 weight percent tungsten; ≤99, ≤99.5, ≤99.75, or ≤99.9 weight percent tungsten; ≥0.01, ≥0.05, ≥0.25, ≥0.5, or ≥0.95 weight percent lanthanum oxide; and ≤1, ≤3, or ≤5 weight percent lanthanum oxide. As used herein, the term lanthanum oxide means a chemical compound of lanthanum and oxygen in any ratio, including $La_2O_3$ and non-stoichiometric combinations of lanthanum and oxygen.

An electrically-insulative enclosure 13 can be attached or sealed to the cathode 11 and the anode 12, can electrically insulate the cathode 11 from the anode 12, and can have an interior through which the electron beam can pass.

Examples of material composition of the electrically-insulative enclosure 13 include ceramic, glass, or combinations thereof.

As illustrated in FIG. 1, x-ray source 10 can further comprise an x-ray window 23, separate from the target material, separate from the electrically-insulative enclosure 13, covering the x-ray hole 19 at the exterior $\mathbf{12}_E$ of the anode 12, and hermetically sealed to the anode 12. The electron hole 14 and the x-ray hole 19 can be located within the hermetic seal.

As illustrated in FIG. 2, the electrically-insulative enclosure 13 of x-ray source 20 can also form an x-ray window at the x-ray hole 19 at the exterior $\mathbf{12}_E$ of the anode 12, in a simple, easy to manufacture, robust design. The electrically-insulative enclosure 13 can be hermetically sealed to the anode 12 with the electron hole 14 and the x-ray hole 19 located at an interior of the electrically-insulative enclosure 13 and within the hermetic seal.

Material of construction of the x-ray window 23 in FIG. 1 or of the electrically-insulative enclosure 13 in FIG. 2 can be selected for optimal transmission of x-rays and for strength. For example, material of construction of the x-ray window 23, the electrically-insulative enclosure 13, or both can comprise alumina, zirconia, beryllia, quartz, glass, or combinations thereof.

Thickness $Th_{23}$ of the x-ray window 23 in FIG. 1 or a thickness $Th_{13}$ of the electrically-insulative enclosure 13 in FIG. 2 can be selected for optimal transmission of x-rays and for strength. For example, the thickness $Th_{23}$ or $Th_{13}$ can be ≥0.15 mm, ≥0.5 mm, ≥1 mm, or ≥1.25 mm; and can be ≤2 mm, ≤5 mm, ≤10 mm, or ≤15 mm. Other thicknesses are possible, depending on the energy of x-rays and material of construction of the x-ray window.

As illustrated in FIGS. 3*a*, 3*b*, and 4, x-ray sources 30*a*, 30*b*, and 40 are shown comprising an x-ray tube 20 or 42 and a heat sink 35. X-ray sources 30*a* and 30*b* include a side-window x-ray tube 20 like those described above, but the heat sink 35 is also applicable to any side-window x-ray tube, including x-ray tube 10. X-ray source 40 includes a transmission-target x-ray tube 42. The heat sink 35 is applicable to any transmission-target x-ray tube. Like x-ray tubes 10 and 20, x-ray tube 42 can include a cathode 11 and an anode 12 electrically insulated from one another, the cathode 11 configured to emit electrons in an electron beam 17 towards the anode 12, and the anode 12 including target material configured to emit x-rays 18 out of the x-ray tube 42 in response to impinging electrons from the cathode 11. Illustrated in FIGS. 5-9 are x-ray sources 50, 70, and 90 (FIG. 9) with x-ray tube 51 and a heat sink 35. X-ray tube 51 can be any x-ray tube design, including x-ray tubes 10, 20, and 42 described herein.

The heat sink 35 can be thermally coupled to the anode 12. As used herein, the term "thermally coupled" means that the coupled devices are joined by materials or methods for reducing resistance to heat transfer. The heat sink 35 can be in thermal contact with the anode 12. As used herein, the term "thermal contact" means that the devices in thermal contact with each other are (a) directly touching; or (b) not directly touching but all material(s) between the devices have a coefficient of thermal conductivity of at least 1 W/(m*K). The term "thermal contact" can mean not directly touching but connected by material(s) having a coefficient of thermal conductivity of ≥2 W/(m*K), ≥20 W/(m*K), ≥50 W/(m*K), ≥100 W/(m*K), or ≥200 W/(m*K) if explicitly so stated in the claims. For example, a thermal grease or thermal paste can adjoin the heat sink 35 and the anode 12. Thus, for example, thermal resistance for conduction times area of heat transfer between target material of the anode 12 and the heat sink 35 can be ≤0.01 $K*m^2/W$, ≤0.001 $K*m^2/W$, or ≤0.0005 $K*m^2/W$.

The heat sink 35 can extend away from the anode 12 towards the cathode 11 along a heat sink longitudinal axis 33. The heat sink 35 can have a base 31 and a fin 34 extending from the base 31. The fin 34 can be a single continuous fin wrapping multiple times around the base 31. The fin 34 can be a plurality of wires extending away from the base 31.

The fin 34 can comprise an array of fins 36, which can be arrayed along the heat sink longitudinal axis 33. Fins 34 of the array of fins 36 can be parallel with respect to each other. Each fin 34 of the array of fins 36 can extend from the base 31 in a direction perpendicular to or parallel to the heat sink longitudinal axis 33 (i.e. a plane of each fin 34 can be perpendicular to or parallel to the heat sink longitudinal axis 33) depending on direction of air flow. For example, the fins 34 of x-ray sources 30, 40, 50, and 70 extend from the base 31 in a direction perpendicular to the heat sink longitudinal axis 33. As another example, the fins 34 of x-ray source 90 extend from the base 31 in a direction parallel to the heat sink longitudinal axis 33, as shown in FIG. 9. As shown in FIGS. 5-6, fins 34 of the array of fins 36 can be annular and can circumscribe the base 31 (multiple fins 34 of the array of fins 36 extending into the page of FIGS. 5-6).

As illustrated in FIGS. 3*a* and 4, each fin 34 can have a constant cross-sectional width W from a proximal end $\mathbf{34}_p$ adjoining the base 31 to a distal end $\mathbf{34}_d$ farthest from the base 31. In contrast, as illustrated in FIG. 3*b*, each fin 34 can have a changing cross-sectional width from the proximal end 34*p* adjoining the base 31 to the distal end $\mathbf{34}_d$ farthest from the base 31. For example, each fin 34 can have a largest cross-sectional width $W_p$ at the proximal end $\mathbf{34}_p$ and a smallest cross-sectional width $W_d$ at the distal end $\mathbf{34}_d$. This changing cross-sectional width W can be gradual or smooth. This changing cross-sectional width W of the fins 34 can also apply to a transmission-target x-ray tube.

Outermost fins $\mathbf{34}_o$ can be wider than inner fins $\mathbf{34}_i$ (fins 34 between the two outermost fins $\mathbf{34}_o$). The inner fins $\mathbf{34}_i$ (FIG. 4) can provide improved heat transfer, and the thicker outermost fins $\mathbf{34}_o$ (FIG. 4) can provide protection to the inner fins $\mathbf{34}_i$. Following are example relationships between a maximum width $W_o$ of the two outermost fins $\mathbf{34}_o$ and a maximum width $W_i$ of the inner fins $\mathbf{34}_i$: $W_o>W_i$; $W_o/W_i\geq1.25$, $W_o/W_i\geq1.5$, $W_o/W_i\geq1.75$, or $W_o/W_i\geq2$; and $W_o/W_i\leq3$, $W_o/W_i\leq4$, or $W_o/W_i\leq6$. Also, for improved heat transfer, width W of fins $\mathbf{34}_N$ (FIG. 3*a*) nearer the anode 12 can have a different width W than fins $\mathbf{34}_F$ (FIG. 3*a*) farther from the anode 12.

A maximum width $W_G$ (FIG. 4) of a gap between adjacent fins 34 compared to the maximum width W; (FIG. 4) of the inner fins $\mathbf{34}_i$ (FIG. 4) can be optimized for heat transfer. For example: $W_G/W_i\geq1.05$ or $W_G/W_i\geq1.5$ and $W_G/W_i\leq1.3$, $W_G/W_i\leq1.5$, or $W_G/W_i\leq1.8$.

As shown in FIGS. 3*a*, 5, and 6, for improved x-ray source usage and manufacturability, a distance 37 from the heat sink longitudinal axis 33 to a distal end of each fin 34 can be the same for all fins 34. This distance 37 can be measured within a plane or any plane parallel to and passing through the heat sink longitudinal axis 33.

As illustrated in FIGS. 3*a*-4, for improved x-ray source usage and manufacturability, each fin 34 can have a larger surface area than fins closer to the anode 12 along the heat sink longitudinal axis 33. The array of fins 36 can include a smaller surface area of fins $\mathbf{34}_N$ nearer the anode 12 and increasing surface area of fins 34 along the heat sink longitudinal axis 33 to a larger surface area of fins $\mathbf{34}_F$ farther from the anode 12. For example, a surface area of a fin $\mathbf{34}_F$ farthest from the anode 12 divided by a surface area of a fin $\mathbf{34}_N$ nearest the anode 12 can be ≥1.1, ≥1.3, ≥1.5, or ≥2.

As illustrated in FIGS. 7-8, the fins 34 of x-ray source 70 can extend in each of two opposite directions D1 and D2 away from the heat sink longitudinal axis 33. An outer perimeter 72 of the fins 34 in each of the two opposite directions D1 and D2 can have a convex shape, which convex shape can be perpendicular to the heat sink longitudinal axis 33. The convex shape can match a shape of the x-ray tube 10 or 42, can allow the x-ray source to be inserted into smaller locations, and can be easier to manufacture. An outer surface 73 of the base 31 can also have a convex shape for improved air flow past the base 31. A plane 43 (FIG. 4) of each fin 34 extending in one of the two opposite directions D1 and D2 can be aligned with a plane 43 of a paired fin 34 extending in the other of the two opposite directions D2. Such alignment can improve air flow, manufacturability, or both.

The array of fins 36 can include two opposite flat sides F at the outer perimeter 72 facing in opposite directions and located between the convex shapes of the fins. Each opposite flat side F can provide a surface for mounting a fan 71. As illustrated in FIGS. 7-8, the fans 71 can be mounted at each of the two opposite flat sides F. One of the fans $\mathbf{71}_a$ can be configured to blow towards the heat sink 35 and the other fan $\mathbf{71}_b$ can be configured to draw air away from the heat sink 35.

The fins 34 at the two opposite flat sides F at a location closest to the base 31 can have a small maximum height H or can be completely removed. For example, a maximum height H of each of the fins at the two opposite flat sides can be ≤0.5 mm, ≤1 mm, or ≤3 mm.

For improved heat transfer, the base 31 can have a tapered increase in thermal resistance for conduction moving away from the anode 12. For example, the thermal resistance for conduction of the base farthest from the anode 12 can be ≥1.5 times, ≥2 times, ≥3 times, or ≥5 times the thermal resistance for conduction of the base nearest the anode 12.

Referring again to FIGS. **3*a*-6, this tapered increase in thermal resistance for conduction can be accomplished by the base 31 having a tapered reduction in thickness moving away from the anode 12. Examples of an angle A2 (FIGS. 3*b* and 4) of such taper with regard to the heat sink longitudinal axis 33 include ≥1°, ≥3°, or ≥5° and ≤15°, ≤25°, or ≤50°. The base 31 can have a greater thickness $Th_1$ (FIGS. 3*a* and 4-6) nearest the anode 12 with reducing thickness along the heat sink longitudinal axis 33 to a smaller thickness $Th_2$ farthest from the anode 12. Following are some example relationships between these two thicknesses $Th_1$ and $Th_2$: $Th_1/Th_2 \geq 1.3$, $Th_1/Th_2 \geq 1.5$, $Th_1/Th_2 \geq 2$, or $Th_1/Th_2 \geq 2.5$ and $Th_1/Th_2 \leq 5$, $Th_1/Th_2 \leq 10$, or $Th_1/Th_2 \leq 20$. This reducing thickness is measured perpendicular to the heat sink longitudinal axis 33 and in a single plane parallel to and passing through the heat sink longitudinal axis 33. This reducing thickness can be on each of two opposite sides of the heat sink longitudinal axis 33. This reducing thickness can improve heat transfer from the end of the base nearer the anode 12 to the end of the base 31 farther from the anode 12**.

A hole or bore can extend through the base 31. This bore can be aligned with the heat sink longitudinal axis 33. The bore can have opposite ends with the x-ray tube 10, 20, 42, or 51 mounted at one of the ends. The x-ray tube, cables 32 for providing electrical power to the x-ray tube, or both, can pass through the bore.

As illustrated in FIGS. 10-12, a method of forming an anode 12 for an x-ray tube can comprise some or all of the following steps, which can be performed in any order or simultaneously unless specific order is specified. There may be additional steps not described below. The anode 12 can have properties as described above. The method can comprise boring a hole, defining an electron hole 14, from an exterior $\mathbf{12}_E$ of the anode 12, defining an electron entry 21, into a core 16 of the anode 12; and boring a hole, defining an x-ray hole 19, from an exterior $\mathbf{12}_E$ of the anode 12, defining an x-ray exit 22, into the core 16 of the anode 12.

The method can further comprise inserting target material 101 through the electron hole 14, the x-ray hole, or both into the core. The target material 101 can then be brazed, pressed, or both onto a wall of the core 16. A material composition of the target material 101 can be different from a material composition of the anode 12. An order of steps of the method can be boring the electron hole 14; inserting the target material 101; brazing the target material 101, pressing the target material 101, or both onto the wall of the core 16; then boring the x-ray hole 19. An alternative order of steps of the method can be boring the x-ray hole 19; inserting the target material 101; brazing the target material 101, pressing the target material 101, or both onto the wall of the core 16; then boring the electron hole 14.

As illustrated in FIGS. 11-12, the method can further comprise boring a hole, defining a target hole 111, from an exterior $\mathbf{12}_E$ of the anode 12 into the core 16 of the anode 12, then inserting a plug of target material 121 into the target hole 111. A benefit of using a plug of target material 121 is that its surface $\mathbf{121}_s$ can be curved or otherwise modified for shaping of the x-ray beam. Another benefit is increased flexibility of selection of target material. The target material can also be applied to a surface of the anode 11 by sputtering or electroplating, or electroless plating. Alternatively, the anode 12 can be made of the target material. A selection of the former methods for providing target material in the core 16 can be based on cost of the method, cost of the desired target material, and whether the target material matches requirements of the anode 12.

Following are additional, possible variations of the method. The following variations can be combined in any order. Material composition of the anode 12 can be as described above. The anode 12 can be a single, integral, monolithic material. The electron hole 14 and the x-ray hole 19 can form a seamless bore from the electron entry 21 to the x-ray exit 22. Part or all of the walls of the electron hole 14, the x-ray hole 19, or both can be concave, such as with percentages described above. An angle A1 between a first vector V1 and a second vector V2 can have values as described above. Length $L_A$ of the anode 12, diameter $D_A$ of the anode 12, length $L_e$ of the electron hole 14, diameter $D_e$ of the electron hole 14, and $D_S/D_L$, can have values and relationships as described above.

What is claimed is:

1. An x-ray source comprising:

an x-ray tube including a cathode and an anode electrically insulated from one another, the cathode configured to emit electrons in an electron beam towards the anode, and the anode configured to emit x-rays out of the x-ray tube in response to impinging electrons from the cathode;

a heat sink thermally coupled to the anode, and extending away from the anode along a heat sink longitudinal axis;

the heat sink having a base and an array of fins;

the base having a greater thickness nearer the anode and reducing in thickness along the heat sink longitudinal axis to a smaller thickness farther from the anode;

the array of fins extending from the base and arrayed along the heat sink longitudinal axis;

each fin of the array of fins extends from the base in a direction perpendicular to the heat sink longitudinal axis;

the array of fins includes fins extending in each of two opposite directions away from the heat sink longitudinal axis;

an outer perimeter of the fins in each of the two opposite directions has a convex shape perpendicular to the heat sink longitudinal axis; and the array of fins includes two opposite flat sides extending from the convex shape at the outer perimeter in one of the two opposite directions to the convex shape at the outer perimeter in the other of the two opposite directions, each opposite flat side providing a surface for mounting a fan.

2. The x-ray source of claim 1, wherein $Th_1/Th_2 \geq 1.5$, where $Th_1$ is the greater thickness of the base nearer the anode, $Th_2$ is the smaller thickness of the base farther from the anode, both thicknesses measured perpendicular to the heat sink longitudinal axis and in a single plane parallel to and passing through the heat sink longitudinal axis.

3. The x-ray source of claim 2, wherein $10 \geq Th_1/Th_2 \geq 2$.

4. The x-ray source of claim 1, wherein the greater thickness nearer the anode and reducing in thickness along the heat sink longitudinal axis to the smaller thickness farther from the anode is on each of two opposite sides of the heat sink longitudinal axis.

5. The x-ray source of claim 1, wherein fins of the array of fins are annular and circumscribe the base.

6. The x-ray source of claim 1, wherein $3 \geq Th_o/Th_i \geq 1.5$, where $Th_o$ is a maximum thickness of two outermost fins and $Th_i$ is a maximum thickness of fins between the two outermost fins, of the array of fins.

7. The x-ray source of claim 1, wherein a maximum height of each of the fins at the two opposite flat sides at a location closest to the base is ≤1 mm.

8. The x-ray source of claim 1, further comprising a fan mounted at each of the two opposite flat sides, one of the fans configured to blow towards the heat sink and the other fan configured to draw air away from the heat sink.

9. The x-ray source of claim 1, wherein an outer surface of the base has a convex shape.

10. The x-ray source of claim 1, wherein a plane of each fin extending in one of two opposite directions is aligned with a plane of a paired fin extending in another of the two opposite directions.

11. The x-ray tube of claim 1, wherein within a plane parallel to and passing through the heat sink longitudinal axis, a distance from the heat sink longitudinal axis to a distal end of each fin is the same for all fins.

12. The x-ray tube of claim 1, wherein a distance from the heat sink longitudinal axis to a distal end of each fin is the same for all fins.

13. The x-ray source of claim 1, further comprising a bore extending through the base and aligned with the heat sink longitudinal axis, the bore having opposite ends; and wherein the x-ray tube is mounted at one of the ends of the bore.

14. The x-ray source of claim 13, wherein the x-ray tube, cables for providing electrical power to the x-ray tube, or both pass through the bore.

15. The x-ray source of claim 1, wherein:

a target material of the anode is configured for generation of the x-rays in response to the impinging electrons; and thermal resistance for conduction times area of heat transfer between the target material and the heat sink is $\leq 0.01\ K*m^2/W$.

16. An x-ray source comprising:

an x-ray tube including a cathode and an anode electrically insulated from one another, the cathode configured to emit electrons in an electron beam towards the anode, and the anode configured to emit x-rays out of the x-ray tube in response to impinging electrons from the cathode;

a heat sink thermally coupled to the anode, and extending away from the anode along a heat sink longitudinal axis;

the heat sink having a base and an array of fins;

the base having a greater thickness nearer the anode and reducing in thickness along the heat sink longitudinal axis to a smaller thickness farther from the anode;

the array of fins extending from the base and arrayed along the heat sink longitudinal axis;

each fin of the array of fins extends from the base in a direction perpendicular to the heat sink longitudinal axis; and the array of fins include a smaller surface area of fins nearer the anode and increasing surface area of fins along the heat sink longitudinal axis to a larger surface area of fins farther from the anode.

17. The x-ray source of claim 16, wherein a surface area of a fin farthest from the anode divided by a surface area of a fin nearest the anode is ≥1.3.

18. The x-ray source of claim 16, wherein the base has a tapered increase in thermal resistance for conduction moving away from the anode.

19. The x-ray source of claim 16, wherein the base has a tapered reduction in thickness moving away from the anode.

20. An x-ray source comprising:

an x-ray tube including a cathode and an anode electrically insulated from one another, the cathode configured to emit electrons in an electron beam towards the anode, the anode including a target material configured to emit x-rays out of the x-ray tube in response to impinging electrons from the cathode, the target material and the anode comprise ≥97 and ≤99.75 weight percent tungsten and ≥0.25 and ≤3 weight percent lanthanum oxide, a total weight percent of all materials in the target material equals 100 weight percent and a total weight percent of all materials in the anode equals 100 weight percent.

* * * * *